US006419046B1

(12) United States Patent
Cubbison

(10) Patent No.: US 6,419,046 B1
(45) Date of Patent: Jul. 16, 2002

(54) SCAFFOLD END CAPS

(75) Inventor: John Cubbison, Grimsby (GB)

(73) Assignee: Ninefields Cubby Limited, Essex (GB)

( * ) Notice: Subject to any disclaimer, the term of this patent is extended or adjusted under 35 U.S.C. 154(b) by 0 days.

(21) Appl. No.: 09/661,695

(22) Filed: Sep. 14, 2000

(30) Foreign Application Priority Data

Dec. 14, 1999 (GB) ..... 9929554

(51) Int. Cl.[7] ..... E04G 1/00

(52) U.S. Cl. ..... 182/129; 182/119; 182/179.1; 182/222

(58) Field of Search ..... 182/119, 129, 182/179.1, 178.1, 178.6, 223, 233, 234; 403/381

(56) References Cited

U.S. PATENT DOCUMENTS

| | | | | | |
|---|---|---|---|---|---|
| 4,331,218 | A | * | 5/1982 | Layher | 182/119 X |
| 4,331,221 | A | * | 5/1982 | Evans et al. | 188/73.44 |
| 4,496,029 | A | * | 1/1985 | Kuroda | 182/118 X |
| 4,572,390 | A | * | 2/1986 | Grittmann | 217/106 |
| 4,844,200 | A | * | 7/1989 | Flint, Jr. | 182/18 |
| 5,141,078 | A | * | 8/1992 | Wood | 182/119 X |
| 5,411,782 | A | * | 5/1995 | Jarvis et al. | 428/57 |
| 5,443,137 | A | * | 8/1995 | Welser | 182/222 X |
| 5,762,441 | A | * | 6/1998 | Karlsen et al. | 403/381 |
| 5,882,136 | A | * | 3/1999 | Pyritz et al. | 182/119 X |
| 5,947,326 | A | * | 9/1999 | O'Hern et al. | 220/802 |
| 6,076,991 | A | * | 6/2000 | Karlsen et al. | 182/119 X |
| 6,170,212 | B1 | * | 1/2001 | Suchyna et al. | 52/480 |
| 6,221,925 | B1 | * | 4/2001 | Constant et al. | 521/53 |

FOREIGN PATENT DOCUMENTS

| | | | | |
|---|---|---|---|---|
| CH | 660391 | * | 4/1987 | 182/119 |
| EP | 0 413 049 A1 | | 2/1991 | |
| EP | 0 864 507 A1 | | 9/1998 | |
| GB | 2939383 A | | 2/1981 | |
| GB | 2 096 565 A | | 10/1982 | |
| GB | 2 290 575 | | 1/1996 | |
| GB | 2350394 | * | 11/2000 | 182/119 |
| NL | 8300500 A | | 1/1984 | |
| NL | 1005299 A | | 8/1998 | |

* cited by examiner

*Primary Examiner*—Bruce A. Lev
(74) *Attorney, Agent, or Firm*—Fish & Richardson, P.C.

(57) ABSTRACT

A scaffold end cap comprises a tapered tubular portion, a flange and a blocking member. The end cap is secured in a scaffold tube by an interference fit resulting from the compression of the end cap as it is pushed into the tube. The end cap prevents debris from entering the scaffold tube, since debris in a scaffold tube can be dangerous especially when scaffold is manipulated above ground level. In an alternative embodiment, the end cap is provided without a flange, in order that the end cap can be located entirely within a scaffold tube. Circumferential ribs are provided on the inner surface of the tubular portion, and longitudinal ribs are provided on the outer surface.

13 Claims, 1 Drawing Sheet

SCAFFOLD END CAPS

FIELD OF THE INVENTION

This invention relates to scaffold end caps.

BACKGROUND OF THE INVENTION

Scaffold tubes are straight elongate metallic tubes which can be connected together to form structures known as scaffold. Scaffold is often constructed, for example, up the face of a building to provide platforms from which work on the face of the building can be carried out without the use of ropes and harnesses and the like.

It has been found that scaffold tubes, because they are formed from hollow open ended tubes, can become resting places for debris both whilst they form part of scaffold and whilst they are in a deconstructed state. Such debris can include welding rods, screwdrivers, dust, liquid and the like. The fact that debris can fall from the scaffold tubes, especially when tubes are manipulated at height when constructing or deconstructing scaffold, poses a potential safety risk. It is an object of the present invention to provide means whereby debris can be prevented from entering open-ended tubes, including scaffold tubes.

It is known to provide for scaffold tubes which appear at around pedestrian level on a pavement or the like a bung, which is usually made to be blue in colour. Such bungs are typically bulbous in shape and have a diameter which is noticeably greater than the outside diameter of the scaffold tube. Their prime purpose is to make the scaffold poles visible so that pedestrians are less likely to walk into them. To achieve their purpose, these bungs tend to be both easily attachable and easily removable.

SUMMARY OF THE INVENTION

In accordance with a first aspect of the present invention, there is provided a scaffold end cap, for blocking the end of a scaffold tube, the end cap comprising:

- a tubular portion having at a first end an external dimension comparable to an internal dimension of the scaffold tube; and
- a blocking member extending transversely across the tubular portion, the end cap being capable of insertion completely into the scaffold tube.

In accordance with a second aspect of the present invention, there is provided a scaffold end cap, for blocking the end of a scaffold tube having an outer diameter and an inner diameter, the end cap comprising:

- a tubular portion having an outer diameter similar to the inner diameter of the scaffold tube and having first and second ends;
- a flange connected at the first end of the tubular portion; the flange being an outwardly projecting flange having an outer diameter generally the same as the outer diameter of the scaffold tube; and
- a blocking member connected across the tubular portion.

Embodiments of the present invention will now be described with reference to the accompanying drawings.

DETAILED DESCRIPTION OF THE PREFERRED EMBODIMENTS

Figure 1:
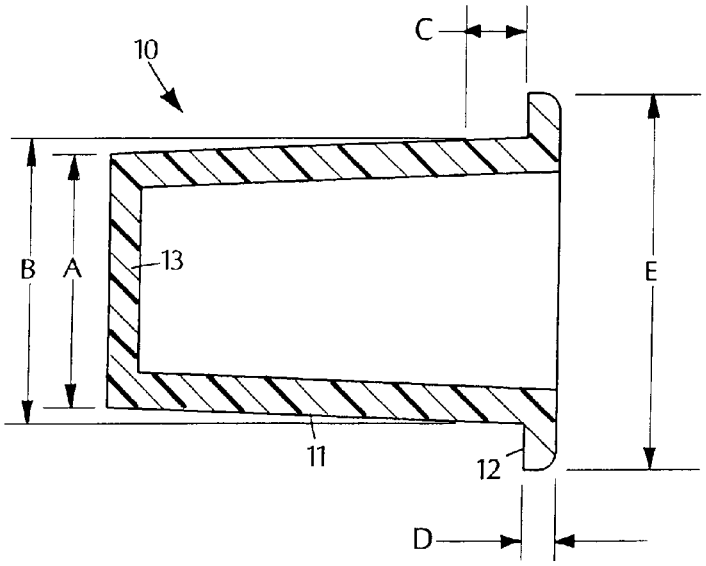
FIG. 1 shows a scaffold end cap in accordance with the present invention.

Referring to FIG. 1, the scaffold end cap 10 comprises generally a tapered tubular portion 11, a rim or flange 12 and a blocking member 13. The end cap 10 is moulded from HDPE coloured with any colorant. The end cap 10 tapers from an outside diameter of 38.0 mm at A to a diameter of 41.0 mm at B, and onto the underside of the flange 12 at substantially the same degree of tapering. The inside diameter of a scaffold tube for which this end cap is suitable is 41.0 mm. The distance C between the underside of the flange 12 to the part of the tubular portion having a diameter of 41.0 mm is 5.0 mm. The thickness D of the plastics material forming the end cap 10 is about 3 mm throughout. The outer diameter E of the flange rim 12 is 49.5 mm. The tapering of the tubular portion 11 allows the end cap 10 to be easily moulded.

Figure 2:
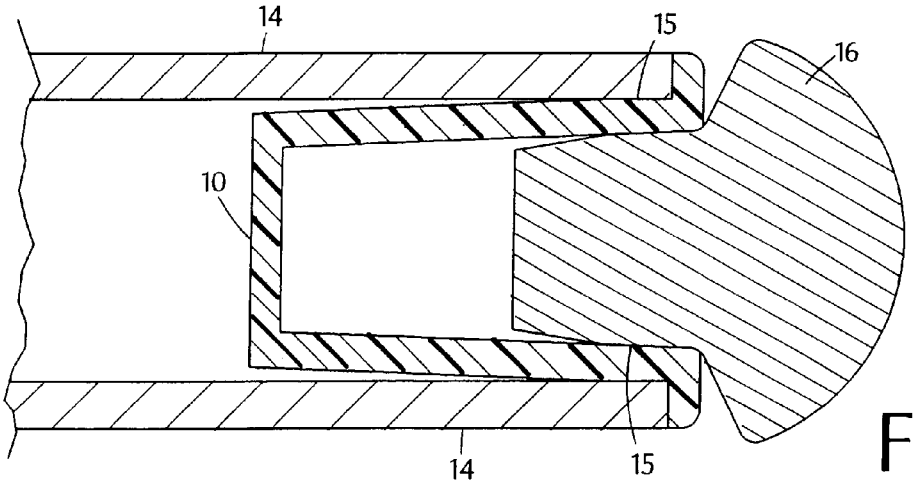
FIG. 2 shows the FIG. 1 scaffold end cap installed in a scaffold tube.

Referring now to FIG. 2, it can be seen that the end cap 10, particularly the tubular portion 11, is distorted at 15 by virtue of its inclusion in a scaffold tube 14. It is preferred for the end cap 10 to be inserted into the scaffold tube 14 with the use of a hammer, the resilience of the plastics material forming the end cap 10 serving to allow deformation of the end cap 10 without shattering or other damage occurring. This resilience allows the end cap 10 to be self securing in the scaffold tube 14 so that it cannot be easily removed either intentionally or accidentally. This type of fit is known as an interference fit. The tapering of the tubular portion 11 eases fitting of the end cap 10 into the scaffold tube 14, as the end furthest from the flange 12 has a diameter smaller than that of the inside diameter of the scaffold tube 14.

The end cap 10 serves to close off the end of the scaffold tube 14 so that it is no longer open for debris to enter. To this end, it will be understood that the blocking member 13 need not be sheet like in structure but could equally well be replaced by a mesh or a series of bars or the like. The range of alternative configurations which would prevent debris entering the scaffold tube 14—it may be that only large debris is desired to be prevented from entering—will be apparent to the skilled person.

The end cap 10 serves also to cover the end face of the scaffold tube 14 and to cover the inner surface of the end of the scaffold tube 14. As both of these parts of the scaffold tube 14 often have metallic burrs and shards, which are formed as a result of the process of cutting scaffold tubes to length, the presence of the end cap 10 makes the scaffold tube 14 safer to hold with fingers placed inside the tube than previously.

Because the end plug 10 is made from HDPE, a significant amount of cushioning is provided on the end of the scaffold tube when the end plug 10 is fitted. This feature provides a less rigid object for contacting with, for example, workmen, machinery and such. HDPE is also chemical resistant.

In FIG. 2, the end cap 10 is shown fitted with a bung 16. The bung 16 is self retained by virtue of its dimensions and the resilience of the material from which it is made. The bung 16 may be used where especially high scaffold tube visibility is required, or where the scaffold tube is to be used near to glass structures and the like. The bung may be made from foam of from a soft-touch material. The bung is preferably blue, although it may be of any colour.

Figure 3:
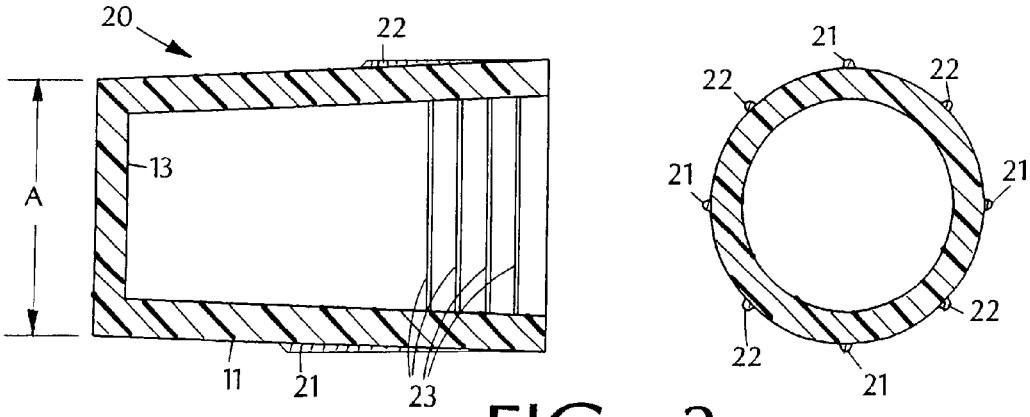
FIG. 3 shows an end section and a lengthways section of a second embodied scaffold end cap in accordance with the present invention.

Referring to FIG. 3, a second embodied end cap 20 comprises generally a tapered portion 11 and a blocking member 13. No flange or rim is present, which allows the end cap 20 to be inserted completely into a scaffold tube (not shown). The external dimensions of the end cap 20 are substantially the same as those of the FIG. 1 end cap, except that the internal length dimension is 75 mm to accommodate easily additional lengths of scaffold feet. The end cap 20 further comprises longitudinal ribs 21 and 22 extending longitudinally on the outer surface of the tubular portion 11 from the wider first end towards the second, blocking member, end of the end cap. The ribs 21 are 22 mm long, and the ribs 22 are 20 mm long. The ribs 21 and 22 are tapered so as to be taller at their end furthest from the wider end of the end cap 20. When the end cap 20 is inserted into a scaffold tube, the ribs 21 and 22 are crushed and shaved off by the inner surface of the scaffold tube. This assists in providing a self-securing interference fit in the scaffold tube.

Circumferential ribs 23 are provided at spaced intervals on the inner surface of the tubular portion 11 of the end cap 20. These ribs 23 allow a scaffold pole in which the end cap is located to be more easily gripped, and provide means for retaining accessories such as flashing lights, tool holders and signs.

What is claimed is:

1. An arrangement comprising a scaffold tube having fitted therein an end cap, the end cap comprising:

a tapered tubular portion;

a blocking member extending transversely across the tubular portion at a position spaced from a first end thereof;

ribs extending substantially longitudinally on the outer surface of the tapered tubular portion, the end cap having external dimensions such that it is retained in the scaffold tube by an interference fit; and a bung fitted into the end cap.

2. An arrangement according to claim 1, in which at least some of the ribs are approximately 20 mm long.

3. An arrangement according to claim 1, in which some ribs are longer than other ribs.

4. An arrangement according to claim 3, in which a longer rib is separated from an adjacent longer rib by at least one shorter rib.

5. An arrangement according to claim 1, in which the ribs are tapered so as to be taller at their end furthest from the first end.

6. An arrangement according to claim 1, in which the scaffold end cap is capable of complete insertion into the scaffold tube.

7. An arrangement according to claim 1, in which the blocking member is at the opposite end of the tapered tubular portion to the first end.

8. An arrangement in accordance with claim 1, in which the tubular portion is tapered so as to be larger in diameter at the first end.

9. An arrangement according to claim 1, in which the end cap is moulded from plastics material as a one-piece component.

10. An arrangement according to claim 9, in which the plastics material is HDPE.

11. An arrangement according to claim 1, comprising ribs extending circumferentially around the inner surface of the tapered tubular portion.

12. An arrangement according to claim 1, in which the bung is made from foam.

13. An arrangement according to claim 1, in which the end cap is open at its first end.

* * * * *